US005141781A

United States Patent [19]

Suzuki et al.

[11] Patent Number: 5,141,781

[45] Date of Patent: Aug. 25, 1992

[54] HIGH ADHESION MOLTEN ALUMINUM-ZINC ALLOY PLATING PROCESS

[75] Inventors: Yoichiro Suzuki, Mizunami; Takashi Nagao, Nagoya, both of Japan

[73] Assignee: Nippon Galvanizing Co., Ltd., Aichiken, Japan

[21] Appl. No.: 626,383

[22] Filed: Dec. 12, 1990

Related U.S. Application Data

[63] Continuation-in-part of Ser. No. 335,755, Apr. 10, 1989, abandoned.

[30] Foreign Application Priority Data

Apr. 14, 1988 [JP] Japan ..... 63-92247

[51] Int. Cl.[5] ..... C23C 2/00

[52] U.S. Cl. ..... 427/398.1; 427/406; 427/431; 427/433

[58] Field of Search ..... 427/431, 433, 398.1, 427/406

[56] References Cited

U.S. PATENT DOCUMENTS

| | | | |
|---|---|---|---|
| 3,758,333 | 9/1973 | Herman | 427/433 |
| 4,059,711 | 11/1977 | Mino | 427/433 |
| 4,216,250 | 8/1980 | Nakayama | 427/433 |
| 4,801,338 | 1/1989 | Quantin | 427/433 |
| 5,049,453 | 9/1991 | Suemitsu | 427/433 |

FOREIGN PATENT DOCUMENTS

| | | | |
|---|---|---|---|
| 2146376 | 9/1970 | Fed. Rep. of Germany | 427/433 |
| 13058 | 1/1984 | Japan | 427/433 |
| 201767 | 9/1986 | Japan . | |
| 295361 | 12/1986 | Japan . | |
| 876032 | 8/1961 | United Kingdom | 427/433 |
| 2080833 | 2/1984 | United Kingdom | 427/433 |

OTHER PUBLICATIONS

English translation of German Patent 2,146,376.
English translation of Japan Patent 13058.

*Primary Examiner*—Shrive Beck
*Assistant Examiner*—Vi Duong Dang
*Attorney, Agent, or Firm*—Arnold, White & Durkee

[57] ABSTRACT

Methods of improving the thickness and characteristics of galvanizing processes are disclosed. Several methods are disclosed which promote growth of the ζ layer in a double dipping galvanizing process. In one process a metal article is dipped in a molten-zinc bath at 430°–480° C. The article is then air-cooled or semi-air-cooled before it is dipped in a molten zinc bath containing no less than 0.1% aluminum at 390°–460° C. In another method, after molten-zinc-plating a metal article at 480°–500° C., the article is plated in a molten zinc bath containing no less than 0.1% of aluminum at 390°–460° C. In a third method, the surface of a metal article is blasted to form a surface having a roughness of at least 20 μm before plating the article in a molten-zinc bath at 430°–480° C. The article is then plated in a molten zinc bath containing no less than 0.1% of aluminum at 390°–450° C.

17 Claims, 2 Drawing Sheets

HIGH ADHESION MOLTEN ALUMINUM-ZINC ALLOY PLATING PROCESS

This application is a continuation-in-part of co-pending U.S. application Ser. No. 335,755 filed Apr. 10, 1989 now abandoned which is incorporated herein by reference. The parent application claimed the priority of Japanese Patent Application No. 63-92247 filed Apr. 14, 1988 which is also incorporated herein by reference.

BACKGROUND OF THE INVENTION

1. Field of the Invention

The present invention relates generally to processes for plating metal articles. More particularly, high adhesion molten aluminium-zinc plating processes are described which improve corrosion resistance especially against salt damage and acid rain.

2. Description of the Related Art

One conventional plating process is to dip a metal article in a molten zinc bath which contains about 5% of aluminum. However, such a process has a general problem in that the presence of the non-plating parts cannot be perfectly prevented even when a specialized flux is used. This is due to the wetability between the metal article and the aluminum-zinc alloy.

The maximum thickness of plating layers formed on the metal article by dipping the metal article into an aluminum-zinc alloy bath is limited to about 30 μm because a thin aluminum-iron alloy layer formed on the critical surface of the iron prevents the growth of zinc-iron alloy layers such as a δ layer and a ζ layer. Therefore, as a matter of practice, it is difficult to adopt this type of plating to exposed materials such as suspension fittings, stringing fittings, general construction members, and so on, in which the corrosion resistance depends on the thickness of the plating layer.

To solve the above problems, metal articles have been initially zinc-plated by dipping in a 99.9% pure molten zinc bath. In a following step the metal articles are further plated by dipping in a molten zinc alloy bath which contains no less than 0.1% of aluminum. (See Japanese Laid-Open Patent Publication No. 61-201767).

However, the described process does not control the development of the plating layer. Specifically, the plating layer does not have time to sufficiently develop. This is because the metal article is passed directly from the zinc bath to the zinc alloy bath. Therefore, in most cases, the plating layer will contain a substantial η layer, which will dissolve at 420° C. Accordingly, the resultant plating layer has a thickness of only 30–60 μm because the η layer is dissolved in the second bath. Such thicknesses are insufficient in many applications because the corrosion resistance depends on the thickness of the plating layer. It is believed that these limitations are due to the failure to consider the theoretical aspects of crystal growth.

During conventional plating of steel (for example) in a molten zinc bath, the zinc plating layer can be initially characterized as three relatively discreet layers. They include a δ layer adjacent the steel, a ζ layer on top of the δ layer and a surface layer η. The various layers differ primarily in their iron concentrations which lead to differences in their crystalline structure and physical properties. One premise of the present invention is that it is generally desirable to develop and maintain a relatively thick ζ layer. A second premise of the invention is that it is desirable to have an alloy bath (after the original zinc bath) which allows aluminum to penetrate into the ζ layer. In effect, the aluminum fortifies the desirable characteristics (especially corrosion resistance) of the plate.

German Laid Open Patent Application No. 2146376 discloses a two dip process wherein a ferrous article is first dipped in a zinc bath followed by hot dipping in an alloy bath. Two distinct alloy bath are described. The first alloy bath includes 5% Al and 4% Cu in a 400° C. bath. The second alloy bath includes 20% Al, 5% Mg and 1% Si at 460°–470° C. The presence of Cu in the first bath has several disadvantages. For example, when steel is used as the article to be plated, a copper layer will form on the surface of the steel and an Al-Zn alloy will form over the copper layer. This reduces the corrosion resistance of the article because of the ionic potential of the Cu layer. Specifically, the Cu layer has an ionic potential of about +670 mV, while the Al-Zn plating layer has a potential of about −1000 mV. Copper (as well as the magnesium in the second described bath) also tends to inhibit growth of the ζ layer. The reference further indicates that good plating results are obtained even when the articles are cooled or stored for one day after the first immersion. Such an extended cooling period will cause any ζ layer to transform to a δ layer during cooling. Additionally, it is believed that adding metals such as Ni, Mg, Cu and Pb might be a factor which inhibits the substitution reaction of aluminum during the alloy bath.

Japanese Laid Open Patent Publication No. 61-295361 discloses a hot dip galvanizing method wherein a pure iron work is first dipped in a molten zinc bath at a temperature in the range of 500°–600° C. It is then immediately dipped in a zinc-aluminum alloy bath. However, bath temperatures and the plated materials are specifically chosen to produce a thin δ crystalline structure without forming a ζ layer.

SUMMARY OF THE INVENTION

Accordingly, it is a primary objective of the present invention to provide a high adhesion molten aluminum-zinc alloy plating process which can attain a plating layer thickness of at least 80μ.

Another separate object of the invention is to provide a plating process that promotes growth of the ζ layer before the alloy bath plating step to provide high adhesion plating.

To achieve the foregoing and other objects and in accordance with the purpose of the present invention, a high adhesion molten aluminum-zinc alloy plating process is disclosed. In a first embodiment, a metal article is dipped in a molten zinc bath having a temperature in the range of 430°–480° C. This forms a plating layer having a δ layer formed on the surface of the metal article and a ζ layer formed on the δ layer. The plated surface of the metal article is then air-cooled to grow the ζ layer. The cooling step lasts sufficiently long to provide a ζ layer that is at least 70 microns thick. The metal article is thereafter dipped in a molten zinc bath which contains 0.1–10% of aluminum at 390°–460° C.

In a second embodiment of the invention, the surface of a metal article is plated in a high temperature molten zinc bath above 480° C. to produce a η+ζ plating layer that is at least 70 microns thick. Thereafter, the metal article is dipped into a molten zinc bath which contains 0.1–10% of aluminum at 390°–460° C.

In a third embodiment of the invention, the surface of the metal article is blasted to a surface roughness of at least 20 μm. The blasted surface is then dipped in a molten zinc bath at a temperature in the range of 430°–480° C. to produce combined $\zeta+(\eta+\zeta)$ layers that are at least 70 microns thick. Thereafter, the metal article is dipped into a molten zinc bath which contains 0.1–10% of aluminum at a temperature in the range of 390°–460° C. These steps combine to produce a plating layer that is at least 90 microns thick.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments together with the accompanying drawings in which:

DETAILED DESCRIPTION OF THE PREFERRED EMBODIMENTS

Figure 1A:
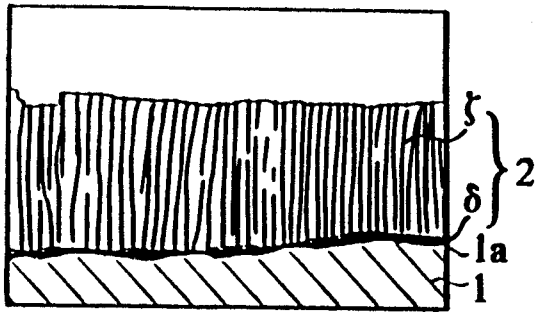
FIG. 1*a* is a sectional plan view of a plating layer formed in the first step of a first embodiment of the invention.
Figure 1B:
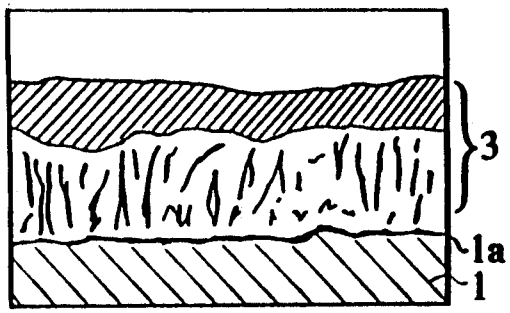
FIG. 1*b* is a sectional plan view of the plating layer after the third step of the first embodiment.

The first embodiment of the high adhesion molten aluminum-zinc alloy plating process of the present invention will be described with reference to FIGS. 1(*a*) and 1(*b*).

A metal article 1 is cleaned in a conventional manner by degreasing-water washing-acid cleaning-and flux treating its surface 1*a*. A plating layer 2 is then formed on the surface 1*a* of a metal article 1 by dipping the metal article in a molten zinc bath. The zinc bath is in the temperature range of 430°–480° C. As shown in FIG. 1(*a*), the plating layer 2 includes a δ layer formed on the surface 1*a* and a ζ layer formed on the surface of the δ layer.

The metal article 1 is then removed from the molten zinc bath and either air-cooled or semi-air cooled to urge the growth of the ζ layer by diffusion of iron. (This is considered the second step). An η layer is formed at the surface of the ζ layer when the material is withdraw from the zinc bath. Diffusion of iron into the η layer causes the ζ layer to grow significantly. This is a result of the self-heating of the metal article 1 during the air-cooling step.

The purpose of the air cooling (or semi air-cooling) step is to grow the ζ layer. If the air cooling is allowed to proceed without restriction, further diffusion of the iron will gradually transform the newly formed ζ layer into a δ layer. Therefore, the cooling step is preferably timed so as to allow the ζ layer to grow. The δ layer is more brittle than the ζ layer and thus, it is most desirable to increase the thickness of the ζ layer. However, it is noted that the air cooling step functions to increase the total plating layer thickness.

By way of example, it is preferred that the ζ layer be grown to a thickness of at least 70μ during the cooling or semi-air cooling step. More preferably, the ζ layer is grown to at least 90μ. ζ layers in the range of 100–180μ are readily attainable.

In a third step, a thicker plating layer 3 is formed by plating the molten zinc plating layer 2 in a pure molten aluminum-zinc alloy bath containing in the range of 0.1 to 10% aluminum. The bath temperature is in the range of 390°–460° C. The resultant plating product is thicker than the plating layers formed in conventional molten zinc plating processes.

By way of example, in a first sample, a ductile cast iron (FCD 40) sample having a plate thickness of 9 mm and a mass of 200 g was used. After the molten zinc bath, the sample was cooled for 120 seconds before dipping in an alloy bath for 50 seconds. The alloy bath was at a temperature of 440° C. and had a composition of 5% Aluminum and 95% Zinc. A second sample used was a 16 mm thick steel plate having a mass of 200 g. It was cooled for 90 seconds before dipping in the same alloy bath. The average plating thicknesses obtained were approximately 120μ. In these particular preferred embodiments, the alloy bath was essentially pure aluminum and zinc.

The resulting plating layer was compared to conventional molten zinc plating products to evaluate its corrosion resistance. Specifically a salt water vapor test (which tests for rusting) was performed. The alloyed plating product has about three times the corrosion resistance of conventional molten zinc plating products.

Preferably, the plating steps are carried out to form a combined plating layer that is at least 100μ thick. More preferably, the specific parameters of time and temperature and concentration are chosen so that a total plating thickness of at least 120μ is obtained.

TABLE I

| No. | PLATING LAYER FORMED IN THE FIRST PLATING | THICKNESS OF THE FIRST PLATING LAYER | THICKNESS OF THE SECOND PLATING LAYER | START-RUSTING HOURS: CONVENTIONAL MOLTEN-ZINC-PLATED PRODUCT | START-RUSTING HOURS: PRESENT ALLOY-PLATED PRODUCT |
|---|---|---|---|---|---|
| 1 | ζ LAYER | 100 μm | 120 μm | 482 HOURS | 1,368 HOURS |
| 2 | (η + ζ) LAYER | 110 μm | 140 μm | 158 HOURS | 1,608 HOURS |
| 3 | ζ + (η + ζ) LAYER | 95 μm | 120 μm | 336 HOURS | 1,248 HOURS |

There are good reasons why the percentage of aluminum in the alloy bath is chosen to be in the range of 0.1–10%. Specifically, the suppressing reaction of the alloy would vanish with less than 0.1% of aluminum. Further, when 5% aluminum is used, the mixed crystallizing temperature is 382° C. At 10% aluminum it is about 450° C. while at 12% it is about 480° C. Higher concentrations of aluminum have even higher crystallizing temperatures. Using more than 10% aluminum would cause problems because the alloy bath temperature must be higher than the crystallizing temperature. Specifically bath temperatures above 460° C. would be required. This is undesirable since such temperatures promote the creation of irregularities in the plating surface. They also increases the probability that the metal article itself will deform in the alloy bath.

The required air-cooling time will vary a great deal depending on the particular articles being plated. As set forth above, the intent of one aspect of the invention is to grow the $\zeta$ layer. In general, the larger the mass of the article, the longer the air cooling step will be. By way of example, cooling times in the range of 20 seconds to four minutes are most common. Air cooling times in the neighborhood of 90–120 seconds worked well for the previously described samples having weights of 200 g. Heavy articles might require cooling for 10 minutes or more. If the alloy plating step does not immediately follow the appropriate air cooling step, the article may be quenched after the appropriate amount of air cooling. This will prevent further diffusion of the iron which would cause further transformation of the $\zeta$ layer to the $\delta$ layer. This is referred to as semi-air-cooling.

Figure 2A:
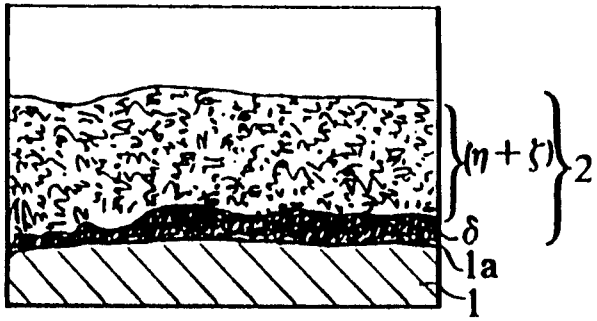
FIG. 2*a* is a sectional plan view of a plating layer formed in the first step of a second embodiment of the present invention.
Figure 2B:
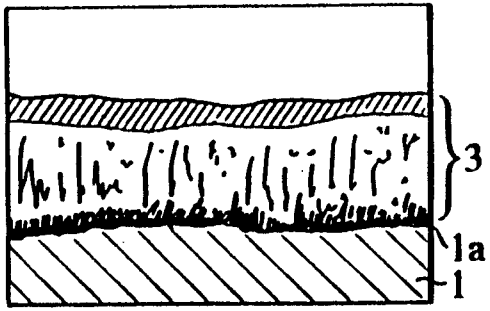
FIG. 2*b* is a sectional plan view of the second embodiment after the second step.

The second embodiment of the present invention will be described with reference to FIGS. 2(*a*) and 2(*b*). In the first step, a plating layer is formed on the surface of a metal article 1 by dipping the article in a molten zinc bath having a temperature above 480° C. As before, the article is dipped only after an appropriate cleaning procedure such as a degreasing-water washing-acid cleaning-water washing-flux treating procedure. The plating layer, (not shown), comprises a $\delta$ layer formed on the surface of the metal article 1, a $\zeta$ layer formed on the $\delta$ layer, and a $(\eta+\zeta)$ layer formed on the $\zeta$ layer.

In the first step, the growth and the diffusion of the $\zeta$ and $(\eta+\zeta)$ layers are urged in a high temperature molten zinc bath in the temperature range of about 480°–560° C., depending on the particular material being plated. In general, plating in the molten zinc bath at temperatures above 480° C. disintegrates the $\zeta$ layer, and causes particles of the $\zeta$ layer to diffuse among the $\eta$ layer to form a mixed crystal texture and to attain a plating layer 2 as shown in FIG. 2(*a*). If the bath temperature is too high it will prevent formation of the $\zeta$ crystal structure. Rather, only $\eta$ and $\delta$ crystal structures will be formed. The actual permissible zinc bath temperatures varies depending primarily on the material being plated. For example, the maximum temperature for boron steel is approximately 500° C. Hot rolled sheet steel (SS400, SS-41) is about 510° C. Normal cast iron is closer to 520° C. and malleable cast iron (FCMB) is about 540° C. In contrast, the upper temperature limit for forming a $\zeta$ layer on pure cast iron is about 480° C. and is not appropriate for this process. Most often, molten zinc bath temperatures in the range of 480°–520° C. would be used in this invention.

Like in the first embodiment, the metal article 1 is then dipped in a molten aluminum-zinc alloy bath in the temperature range of 390°–460° C. which contains 0.1–10% of aluminum. During this second step, a plating layer 3 is grown which is thicker than the plating layer 2 as shown in FIG. 2(*b*). As shown in column No. 2 of Table 1, the thickness of the resultant plating layer 3 is approximately 140 μm. When the alloyed plating product of the present second embodiment is compared with conventional molten zinc plating products, the corrosion resistance against salt damage of the present embodiment is about 10 times better.

The $\zeta+\eta$ layer is grown to a thickness of at least 70μ and preferably the total plating thickness is at least 90μ. In a more preferred embodiment, the thickness of the $\zeta+\eta$ layer is at least 110μ.

The resultant plating is quite different than the plating layers formed by the process disclosed by Koga et al in 1978 publication (42-2) of the Metal Society in Japan and from the results predicted in Japanese Laid-Open Patent Publication No. 61-295361. In those references, the molten zinc bath temperature is specifically chosen to provide a uniform $\delta$ layer and to eliminate the $\zeta$ layer. In contrast, the second embodiment of the present invention seeks to produce a large $\zeta$ layer. Further, the objective of the process described in the patent publication was to form a thin plating layer of about 15μ.

Figure 3A:
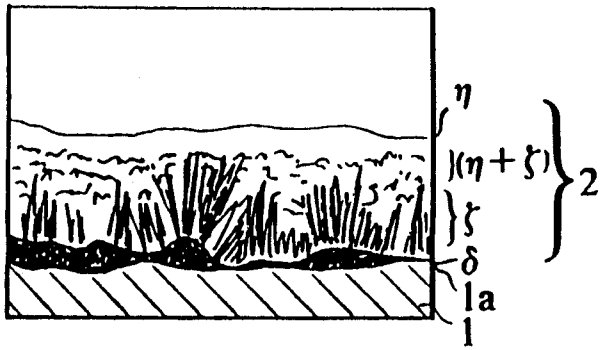
FIG. 3*a* is a sectional plan view of a plating layer formed in the second step of a third embodiment of the present invention.
Figure 3B:
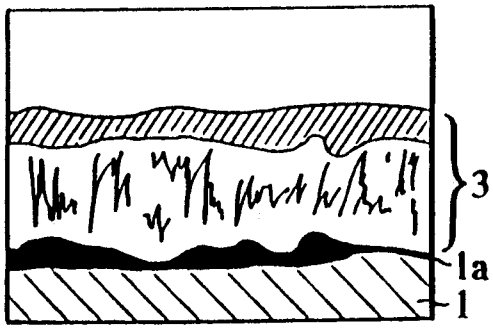
FIG. 3*b* is a sectional plan view of the third embodiment after the third step.

The third embodiment of the present invention will now be described with reference to FIGS. 3(*a*) and 3(*b*). In the first step, the surface 1*a* of a metal article 1 is shot-blasted or sand-blasted so that the plating surfaces have a surface roughness of no less than 20 μm.

In the second step, the plating layer 2 is formed on the surface 1*a* of the metal article 1 by dipping in a molten zinc bath after an appropriate degreasing-water washing-acid cleaning-water washing-flux treating procedure. As shown in FIG. 3(*a*), the plating layer 2 comprises a $\delta$ layer formed on the surface 1*a*, a $\zeta$ layer formed on the $\delta$ layer, a $(\eta+\zeta)$ mixed crystal layer on the $\zeta$ layer, and a $\eta$ layer formed on the $(\eta+\zeta)$ mixed crystal layer.

The growth of the $\zeta$ layer and the $(\eta+\zeta)$ mixed crystal layer is maximized by insuring that the surface roughness of the surface 1*a* is at least 20 μm. As before, the third step entails dipping the initially plated article 1 in a molten aluminum-zinc alloy bath which contains 0.1–10% of aluminum. The resultant plating layer 3 is shown in FIG. 3(*b*).

The $\zeta$ layer grows in every direction on and around projections of the $\delta$ layer on the surface 1*a*. As shown in Table 1, the blasted surface promotes the growth of the $\zeta$ layer and the $(\eta+\zeta)$ mixed crystal layer. Accordingly, as shown in the column No. 3 of the Table 1, the thickness of the plating layer 3 is about 120 μm. When the alloy plating product of the third embodiment is compared with conventional molten zinc plating products, as shown in the column No. 3 of the Table 1, the corrosion resistance against salt damage is about three times better.

The blasting is arranged to insure that the $\zeta$ layer is grown to at least 70μ and the total resultant plating thickness is at least 90μ. In a more preferred arrangement, the $\zeta$ layer is grown to at least 90μ.

The plating thickness obtained by plating according to the various embodiments of the present invention are compared with the plating thicknesses obtained in related arts in Tables 2–5. In each, the results attained after 30 experiments are presented.

Table 2 shows the differences of plating layer thickness between comparison example 1 and a fourth embodiment in which some conditions are more specifically decided in the first embodiment of the present invention. In comparison example 1, the metal article is molten-aluminum-zinc-alloy plated about 20 seconds after being molten-zinc-plated in the comparative example 1, and a metal article is molten-aluminum-zinc-alloy-plated after being air-cooled for one week after being molten-zinc-plated in the fourth embodiment, namely the molten aluminum zinc alloy plating is done as a batch operation. The average thickness of the plating layers of the comparative example 1 is about 60 μm the average thickness of the plating layer of the fourth embodiment, however, is about 112 μm.

TABLE 2

(Unit: μm)

| COMPARATIVE EXAMPLE 1 | THE FOURTH EMBODIMENT |
|---|---|
| 50 47 64 58 60 | 117 112 116 115 105 |
| 56 67 56 73 56 | 103 101 107 116 115 |
| 78 53 66 51 66 | 116 114 108 106 104 |
| 54 66 59 50 44 | 109 118 118 116 114 |
| 57 54 57 51 62 | 107 108 109 102 112 |
| 56 79 58 77 64 | 114 113 112 131 127 |

Table 3 shows the differences of the plating layer thickness between comparative example 2 and a fifth embodiment. The fifth embodiment is similar to the first embodiment however some of its conditions are more specifically decided. The fifth embodiment is water-cooled for 60 seconds after 100 seconds of air-cooling during its plating process. In contrast, the comparative example 2 is water-cooled for 60 seconds after just 20 seconds of air-cooling during its plating process. The average thickness of the plating layers of the comparative example 2 is 43 μm. The average thickness of the plating layer of the fifth embodiment is, however, about 120 μm.

TABLE 3

(Unit: μm)

| COMPARATIVE EXAMPLE 2 | THE FIFTH EMBODIMENT |
|---|---|
| 48 42 36 38 52 | 114 98 108 119 120 |
| 46 51 50 44 33 | 135 134 136 110 132 |
| 51 37 41 37 30 | 125 116 121 107 113 |
| 36 54 47 52 52 | 92 140 130 128 132 |
| 47 43 39 32 36 | 121 116 107 95 128 |
| 38 34 56 42 48 | 126 119 120 127 130 |

Table 4 shows the differences of the plating layer thickness between comparative examples 3 and a sixth embodiment. The sixth embodiment corresponds to the second embodiment with some conditions being more specifically decided. The first plating is done at 440°–460° C. on the comparative example 3 and is done at 480° C. on the sixth embodiment. The samples used were ductile cast iron, FCD 40. It is clearly shown in the Table 4 that the comparative example 3 has an average thickness of 60 μm and the sixth embodiment has an average thickness of 91 μm.

TABLE 4

(Unit: μm)

| COMPARATIVE EXAMPLE 3 | THE SIXTH EMBODIMENT |
|---|---|
| 59 61 62 59 58 | 87 95 96 87 85 |
| 61 61 60 63 58 | 94 93 92 101 86 |
| 59 59 58 59 57 | 96 87 85 93 92 |
| 61 59 58 59 57 | 87 89 86 94 97 |
| 57 65 63 63 68 | 95 87 86 88 82 |
| 59 62 59 59 61 | 83 106 100 115 87 |

Table 5 shows the differences of the plating layer thickness between comparative examples 4 and a seventh embodiment of the present invention. The seventh embodiment resembles the third but has some conditions more specifically set. Specifically, the metal article is blasted to a surface roughness of no less than 25 μm before the article is dipped in the molten zinc bath. In comparative examples 4 the metal article is not blasted before the first plating step. As seen in Table 5, the average of the plating layer thickness of the comparative examples 4 is 54 μm. The average of the plating layer thickness of the seventh embodiment is, however, excellently improved to 120 μm.

TABLE 5

(Unit: μm)

| COMPARATIVE EXAMPLE 4 | THE SEVENTH EMBODIMENT |
|---|---|
| 62 66 58 47 52 | 112 108 99 132 125 |
| 49 53 61 62 53 | 124 130 104 108 110 |
| 52 49 55 47 51 | 116 124 132 119 108 |
| 63 68 49 58 56 | 106 114 121 126 124 |
| 60 51 52 48 52 | 122 119 134 130 125 |
| 54 42 46 49 61 | 118 117 119 120 131 |

Figure 4:
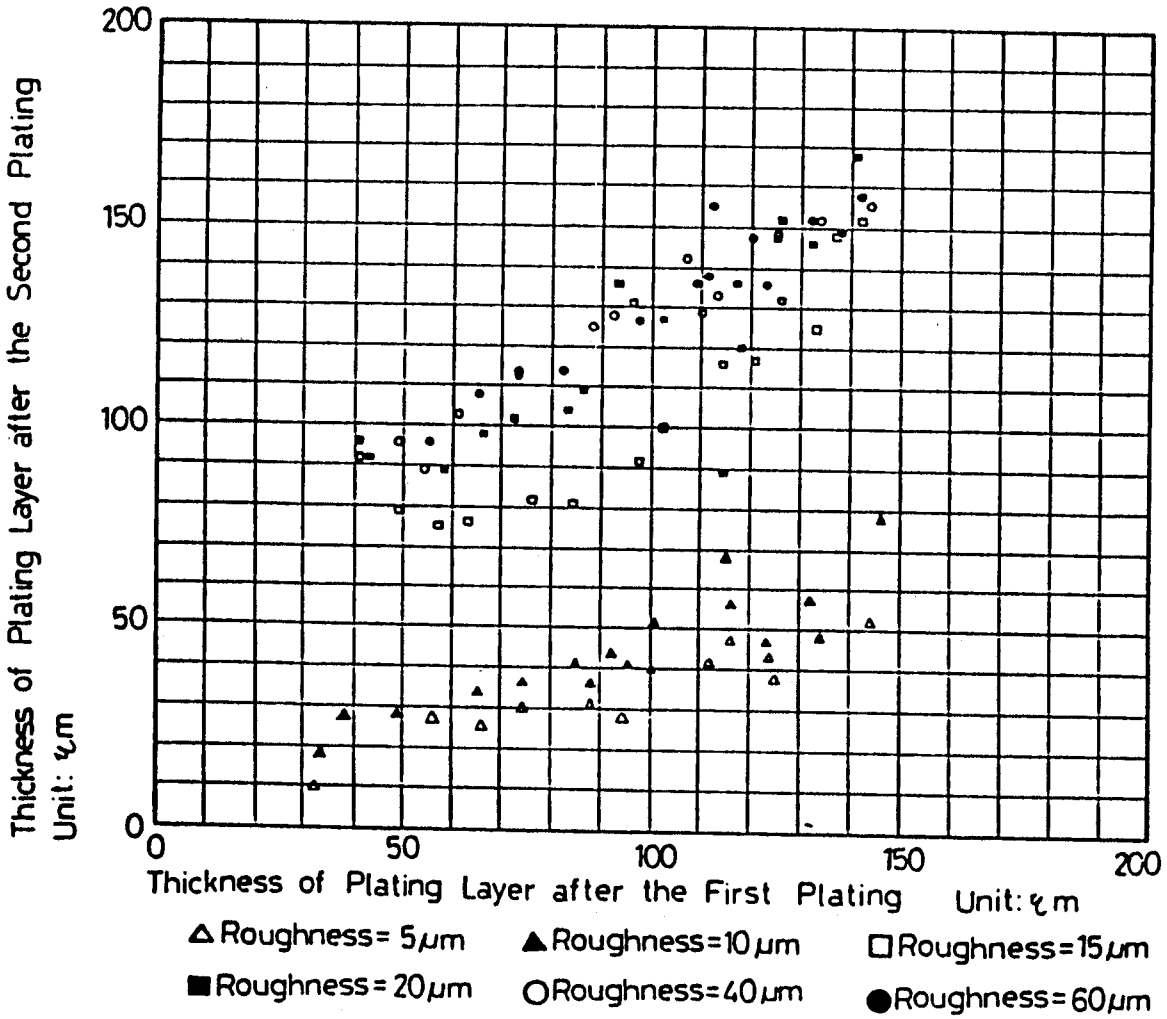
FIG. 4 is a graph showing the relationship between the roughness of the surface of a metal article and the thickness of the plating layer after the second plating step.

Referring next to FIG. 4, it can be seen that the experimental data shows that a plating layer of no less than 80 μm can surely be attained when the roughness of the surface of the metal article 1 is at least 20 μm.

The described plating processes can be applied to a wide variety of the metal articles. By way of example, (1) bolts and nuts, (2) suspension fittings, (3) stringing fittings, (4) springs, (5) outfits, (6) constructive elements for guardrails, (7) kitchen apparatus, (8) members for construction, (9) constructive members for bridges, (10) constructive members for towers, (11) gates and doors, (12) sashes, (13) support poles for antennas, (14) split pins, (15) zinc die-cast products, (16) steel plates for automobile, (17) steel plates for light reflection, (18) steel plates for heat reflection, (19) base steel plate for painting, (20) electric poles, (21) tanks, and (22) fish preserves.

Although only a few embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

We claim:

1. A high adhesion molten aluminum-zinc alloy plating process comprising:

a first step in which a surface of a metal article is dipped in a molten zinc bath having a temperature in the range of 430°–480° C., to form a plated layer having a δ layer formed on the surface of the metal article and a ζ layer formed on the δ layer;

a second step in which the plated surface of said metal article is air-cooled after said first step to grow the ζ layer, the cooling step lasting sufficiently long to provide a ζ layer that is at least 70 microns thick; and a third step in which said metal article having a ζ layer that is at least 70 microns thick is plated in a molten zinc bath which contains in the range of 0.1–10% of aluminum at a temperature in the range of 390°–460° C.

2. A plating process as recited in claim 1 wherein said air cooling step lasts in the approximate range of 20 seconds to four minutes.

3. A plating process as recited in claim 1 wherein said air cooling step lasts in the range of 2 to 10 minutes.

4. A plating process as recited in claim 1 wherein said air cooling step is followed by a quenching step after the $\zeta$ layer grown to at least 90 microns.

5. A plating process as recited in claim 1 wherein said air cooling step lasts sufficiently long to provide a $\zeta$ layer that is at least 90 microns thick.

6. A plating layer as recited in claim 5 wherein said steps combine to produce a plating layer that is at least 120 microns thick.

7. A plating process as recited in claim 1 wherein said steps combine to produce a plating layer that is at least 100 microns thick.

8. High adhesion molten aluminum-zinc alloy plating process comprising:

a first step in which a surface of a metal article is plated in a molten zinc bath at a termperature above 480° C. to produce a plating layer having a $\eta+\zeta$ layer that is at least 70 microns thick; and a second step in which said metal article after said first step is plated in molten zinc alloy bath which contains in the range of 0.1-10% of aluminum at 390°-460° C.

9. A plating process as recited in claim 8 wherein the molten zinc bath has a temperature less than 520° C.

10. A plating process as recited in claim 9 wherein said molten zinc bath has a temperature in the range of 480°-500° C.

11. A plating process as recited in claim 8 wherein said steps combine to produce a plating layer that is at least 80 microns thick.

12. A plating process as recited in claim 8 wherein said steps combine to form a $(\eta+\zeta)$ layer that is at least 110 microns thick.

13. High adhesion molten aluminum-zinc alloy plating process comprising:

a first step in which a surface of a metal article is blasted into no less than 20 $\mu$m roughness;

a second step in which the blasted surface of said metal article is plated in molten zinc bath having a temperature in the range of 430°-480° C. to form a plating layer having a combined $\zeta+(\eta+\zeta)$ layer that is at least 70 microns thick; and a third step in which said metal article after said second step is plated in molten zinc bath which contains in the range of 0.-10% aluminum at a temperature in the range of 390°-460° C., said steps combining to produce a total plating layer that is at least 90 microns thick.

14. A plating process as recited in claim 13 wherein said steps combine to produce a $\zeta+(\eta+\zeta)$ layer that is at least 90 microns thick.

15. A high adhesion molten aluminum-zinc alloy plating process comprising:

a first step in which a surface of a metal article is dipped in a molten zinc bath having a temperature in the range of 430°-480° C., to form a plated layer having a $\delta$ layer formed on the surface of the metal article and a $\zeta$ layer formed on the $\delta$ layer;

a second step in which the plated surface of said metal article is air-cooled after said first step to grow the plating layer to a thicknes of at least 70$\mu$; and a third step in which said metal article having a $\zeta$ layer that is at least 70 microns thick is plated in a molten bath consisting essentially of molten zinc and aluminum at a temperature in the range of 390°-460° C., the bath containing in the range of 0.1-10% aluminum.

16. A plating process as recited in claim 15 wherein said steps combine to form a plating layer that is at least 100 microns thick.

17. A high adhesion molten aluminum-zinc alloy plating process comprising:

a first step in which a surface of a metal article is plated in a molten zinc bath; and a second step in which said metal article after said first step is plated in molten zinc alloy bath which contains in the range of 0.1-10% of aluminum at 390°-460° C., said steps combining to produce a plating layer including one or more layers that include a $\zeta$ crystalline structure that have a combined thickness of at least 70 microns.

* * * * *

UNITED STATES PATENT AND TRADEMARK OFFICE

CERTIFICATE OF CORRECTION

PATENT NO. : 5,141,781

DATED : August 25, 1992

INVENTOR(S) : Suzuki, et al

It is certified that error appears in the above-identified patent and that said Letters Patent is hereby corrected as shown below:

At column 9, line 3, "grown" should read --has grown--.

At column 9, line 17, "termperature" should read --temperature--.

At column 10, line 5, "0." should read --0.1--.

At column 10, line 21, "thicknes" should read --thickness--.

Signed and Sealed this

Twenty-first Day of September, 1993

Bruce Lehman

*Attest:*

BRUCE LEHMAN

*Attesting Officer*

*Commissioner of Patents and Trademarks*